United States Patent [19]

LeLong et al.

[11] Patent Number: 5,074,284

[45] Date of Patent: Dec. 24, 1991

[54] FIREPLACES OF THE TYPE WITH CLOSED HEARTH AND WITH VISIBLE COMBUSTION

[76] Inventors: Dominique LeLong, Quartier de Suze, FR - 07800 Charmes Sur Rhone; Jean-Paul Domergue, Les Taureaux, FR - 26300 Besayes, both of France

[21] Appl. No.: 674,443

[22] Filed: Mar. 25, 1991

[30] Foreign Application Priority Data

Mar. 23, 1990 [FR] France ..... 90 03988

[51] Int. Cl.[5] ..... F24B 1/181

[52] U.S. Cl. ..... 126/519; 126/500; 126/515

[58] Field of Search ..... 126/519, 500, 515, 77, 126/67, 63, 152 R; D23/314, 329, 332, 343, 348; 237/50, 52, 53

[56] References Cited

U.S. PATENT DOCUMENTS

| | | | |
|---|---|---|---|
| 3,455,291 | 7/1969 | Glass | 126/519 |
| 3,499,432 | 3/1970 | Hannebaum | 126/519 |
| 4,112,913 | 9/1978 | Shimek et al. | 126/519 |
| 4,176,652 | 12/1979 | Berg | 126/519 |
| 4,182,305 | 1/1980 | Johnson | 126/515 |
| 4,224,921 | 9/1980 | Petrescne | 126/518 |
| 4,273,096 | 6/1981 | Hannebaum | 126/519 |
| 4,429,680 | 2/1984 | Boidron | 126/532 |

*Primary Examiner*—Larry Jones

*Attorney, Agent, or Firm*—Dowell & Dowell

[57] ABSTRACT

It comprises a hollow base (1) which is connected on the one hand to an evacuation conduit (9), on the other hand to smoke collector tubes (8) which open out upwardly at the apex of a liftable cover (2) with transparent walls. Between this cover (2) and the base (1) there is interposed an admission duct (3) which is pierced with upper slots (3*a*) and with at least one lateral opening (3*b*).

4 Claims, 2 Drawing Sheets

FIREPLACES OF THE TYPE WITH CLOSED HEARTH AND WITH VISIBLE COMBUSTION

BACKGROUND OF THE INVENTION

The present invention relates to fireplaces of the type with closed hearth and with visible combustion.

It is known that fireplaces of this type generally comprise a body of parallelipedic section, of which one of the lateral faces is arranged in the manner of a retractable glass door. Inside this body there open out a lower conduit for the admission of fresh air for combustion of the wood, and an upper conduit for evacuation of the smoke and hot gases, connected to a roof flue.

Under these conditions, it is appreciated that such a fireplace is necessarily built against a wall, combustion being visible only on one face of the assembly.

SUMMARY OF THE INVENTION

On the contrary, the present invention has for its object to enable a fireplace to be constructed which, whilst comprising a closed hearth, allows combustion which is visible on all of its lateral faces.

The fireplace according to the invention is defined in claim 1.

BRIEF DESCRIPTION OF THE DRAWINGS

The accompanying drawing, given by way of example, will enable the invention, the characteristics that it presents and the advantages that it is capable of procuring, to be more readily understood.

DESCRIPTION OF THE PREFERRED EMBODIMENTS

The fireplace shown comprises a hollow base 1 constituted by a box of square section in plan, which base is surmounted by a liftable cover 2 of polyhedral section, in the form of a pyramid with four faces in the embodiment in question. This cover 2 comprises in fact reinforcing irons 2*a* between which are fixed transparent plane walls 2*b*. Between the bottom of this cover 2 and the upper face of the base 1 there is interposed an air admission duct 3 which extends over the periphery of said base 1 and which advantageously supports a grate 4, thus disposed at a certain height above the upper face of the base.

Figure 1:
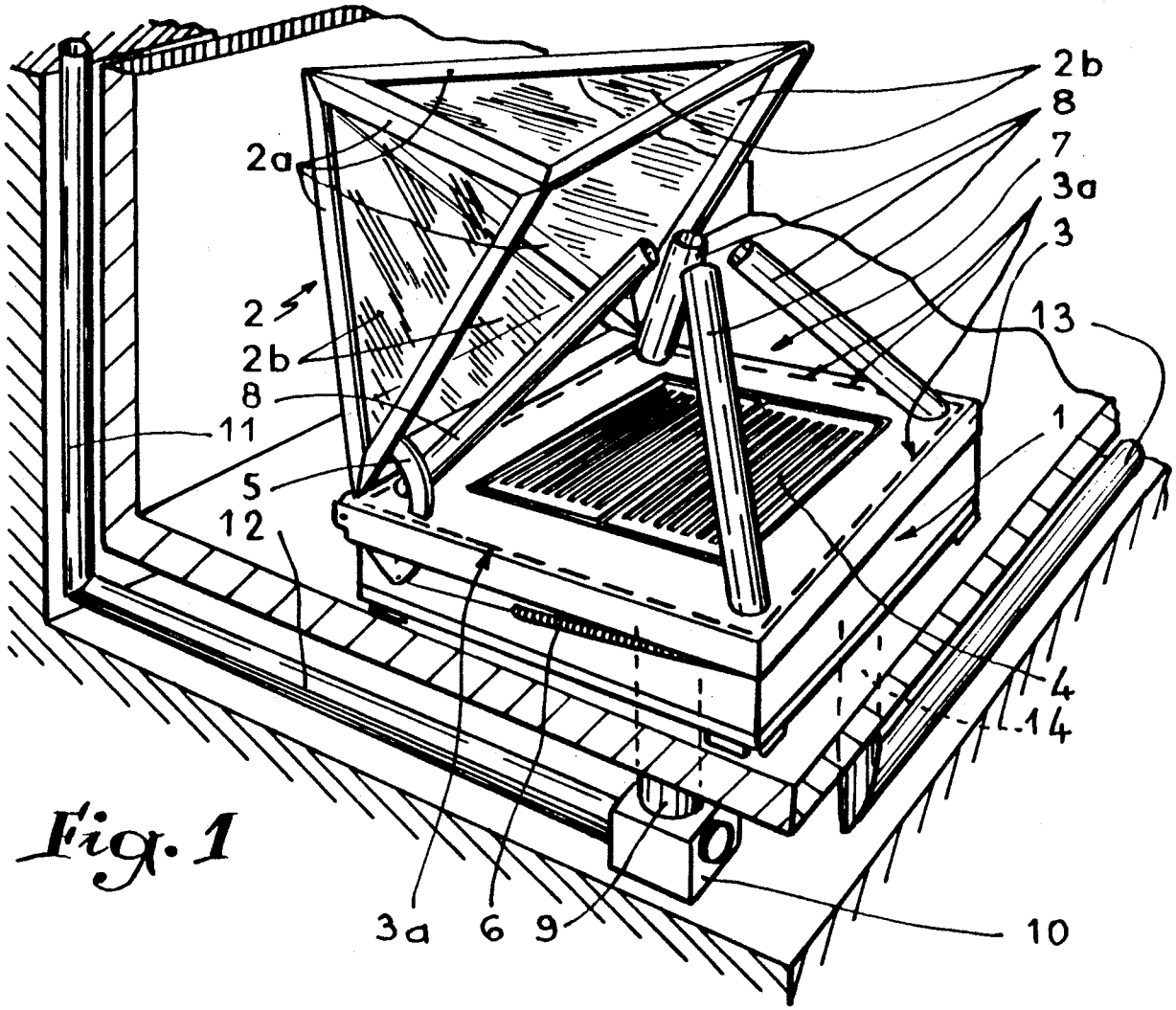
FIG. 1 is a perspective view showing a fireplace according to the invention (with its glass cover in the raised position for charging) and illustrating its implantation in a premises.
Figure 2:
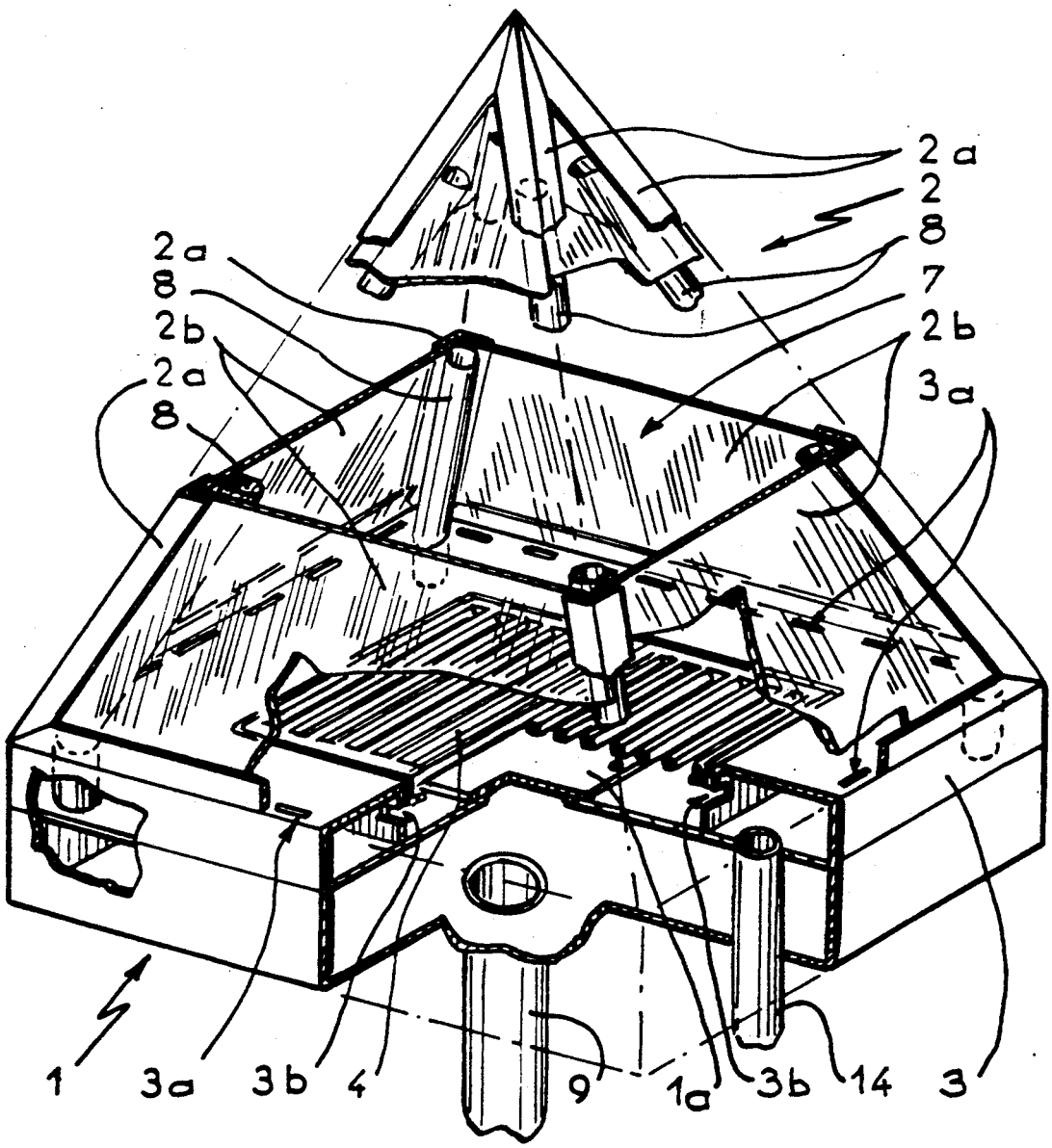
FIG. 2 is a schematic section showing the internal arrangement of the fireplace according to FIG. 1.

It should be observed that one of the sides of the bottom of the cover 2 is articulated on the corresponding side of the duct 3 by means of a compass element 5 and at least one compensating spring 6. The cover 2 is thus capable of taking either a low, operational position (FIG. 2) for which it defines with the base 1 and the duct 3 a combustion chamber 7, or a raised position (FIG. 1) allowing fuel (wood) to be charged in said chamber 7.

At the level of each of the edges of the pyramidal profile of the cover 2, there is provided a fume collector tube 8 of which the upper end opens out at the apex of said cover, whilst its slightly bent bottom traverses the admission duct 3 to open out in the base 1. In this base 1 there also opens out a lower tube 9 which, through a cleaning box 10, is connected to a vertical flue 11 for evacuation of the smoke, the horizontal conduit 12 arranged between the tube 9 and the flue 11 being disposed, with the box 10, in a cavity made in the floor of the premises.

In the same way, there is provided in the floor a pipe 13 of which one end opens to the outside, whilst the opposite end is joined to a vertical tube 14. This latter traverses the base 1 to open out in the admission duct 3. The upper wall of this duct 3 is pierced with slots 3*a* located level with the bottom of the cover 2 in order that the air licks the transparent walls 2*b* thereof, avoiding their blackening under the effect of the smoke; the vertical wall of this duct 3 which faces the grate 4 itself has at least one opening 3*b* cut out therein for the admission of combustion-supporting air inside the combustion chamber 7.

Functioning and use of the fireplace described hereinabove are readily understood.

Once the wood has been laid on the grate 4 and the fire suitably lit, the cover 2 is folded down against the duct 3. The smoke and hot gases released by combustion are evacuated via collector tubes 8; the ashes collected beneath the grate 4 may, by dismantling a central trap 1*a* in the base 1, themselves be evacuated through the cleaning box 10. The fresh air admitted in the duct 3 heats up during its passage in the base 1.

It will be noted that combustion is visible on the four faces of the cover 2.

What is claimed:

1. Fireplace of the type with closed hearth and with visible combustion, characterized in that it comprises in combination:

a liftable cover (2) of polyhedral form of which the lateral faces (2*b*) are transparent;

a hollow base (1) inside which opens out a conduit (9) for evacuation of the smoke and hot gases;

an air admission duct (3) which is interposed between the bottom of the cover (2) and the base (1) and inside which opens out an air inlet tube (14), which duct is pierced on the one hand with slots (3*a*) disposed at the bottom of the transparent faces (2*b*) of the cover (2), on the other hand with at least one opening (3*b*) made laterally in the combustion chamber (7) defined between the base (1), the admission duct (3) and the cover (2);

and smoke collector tubes (8) which are oriented along the edges of the profile of the cover (2) in order to open out, on the one hand, upwardly at the level of the apex thereof, on the other hand, downwardly inside the base (1) whose internal space is connected to a vertical evacuation flue (11).

2. Fireplace according to claim 1, characterized in that the cover (2) is articulated on the admission duct (3).

3. Fireplace according to claim 1, characterized in that the admission duct (3) forms a support for a grate (4) disposed above the upper wall of the base (1).

4. Fireplace according to claim 1, characterized in that the evacuation collector tubes (8) traverse the admission duct (3).

* * * * *